US009372003B2

(12) United States Patent
Harward et al.

(10) Patent No.: US 9,372,003 B2
(45) Date of Patent: Jun. 21, 2016

(54) SPRING CLIP ATTACHMENT FOR A SURFACE COOKING MODULE OF A HOUSEHOLD COOKING APPLIANCE

(71) Applicant: BSH Home Appliances Corporation, Irvine, CA (US)

(72) Inventors: Samuel Harward, Knoxville, TN (US); Clifford Henegar, Speedwell, TN (US); Michael Rutherford, Duff, TN (US); Donnie Smith, Andersonville, TN (US)

(73) Assignee: BSH Home Appliances Corporation, Irvine, CA (US)

( * ) Notice: Subject to any disclaimer, the term of this patent is extended or adjusted under 35 U.S.C. 154(b) by 667 days.

(21) Appl. No.: 13/845,307

(22) Filed: Mar. 18, 2013

(65) Prior Publication Data

US 2014/0263276 A1 Sep. 18, 2014

(51) Int. Cl.
*F24C 15/10* (2006.01)

(52) U.S. Cl.
CPC ..... *F24C 15/108* (2013.01)

(58) Field of Classification Search
CPC ..... F24C 15/108; F24C 3/124; F24C 7/082
See application file for complete search history.

(56) References Cited

U.S. PATENT DOCUMENTS

| | | | | |
|---|---|---|---|---|
| 8,026,462 | B2 | 9/2011 | Arnold et al. | |
| 8,044,328 | B2 | 10/2011 | Boss | |
| 2011/0030669 | A1* | 2/2011 | Leikam | F24C 3/124 126/1 R |
| 2011/0100350 | A1* | 5/2011 | Buck | F24C 15/108 126/214 A |

* cited by examiner

*Primary Examiner* — Jianying Atkisson
(74) *Attorney, Agent, or Firm* — James E. Howard; Andre Pallapies

(57) ABSTRACT

A surface cooking module for a household cooking appliance is provided in which the surface cooking module includes a frame having a front end and a rear end, a front fixation bracket on the front end of the frame, the front fixation bracket for engaging a corresponding first fixation element in a chassis of the household cooking appliance and enabling the frame to pivot about the front end of the frame when engaged with the first fixation element, and a spring clip coupled to the rear end of the frame, the rear end of the frame being opposite the front end of the frame, the spring clip for engaging a second fixation element in the chassis of the household cooking appliance when the cooking module is pivoted downward about the front end of the frame into a mounted position on the household cooking appliance.

24 Claims, 13 Drawing Sheets

SPRING CLIP ATTACHMENT FOR A SURFACE COOKING MODULE OF A HOUSEHOLD COOKING APPLIANCE

FIELD OF THE INVENTION

The present invention is directed to a spring clip attachment for a surface cooking module of a household appliance, a surface cooking module having such a spring clip attachment, and a household cooking appliance having a surface cooking module having such a spring clip attachment.

BACKGROUND OF THE INVENTION

Household cooking appliances are increasingly becoming multi-modal in that these appliances typically now incorporate multiple different types of cooking functions. For example, a household cooking appliance may include one or more of a steam oven, a warming drawer, a convection oven, gas burners, a griddle, a grill, a teppanyaki grill, an induction heating element, or the like. To provide these multiple different types of cooking functions, a household cooking appliance may include one or more surface cooking units installed in a top of the household appliance, such as a range, during manufacturing. For example, one or more surface cooking units can be installed in a top of the household appliance to provide one or more of a gas burner, a griddle, a grill, a teppanyaki grill, an induction heating element, or the like, depending on the options selected by the customer or user.

SUMMARY OF THE INVENTION

The present invention, as illustrated for example in the exemplary embodiments, provides a surface cooking module for a household cooking appliance in which the surface cooking module includes a frame having a front end and a rear end, a front fixation bracket on the front end of the frame, the front fixation bracket for engaging a corresponding first fixation element in a chassis of the household cooking appliance and enabling the frame to pivot about the front end of the frame when engaged with the first fixation element, and a spring clip coupled to the rear end of the frame, the rear end of the frame being opposite the front end of the frame, the spring clip for engaging a second fixation element in the chassis of the household cooking appliance when the cooking module is pivoted downward about the front end of the frame into a mounted position on the household cooking appliance.

The present invention also provides a household cooking appliance including a chassis having a first fixation element and a second fixation element, wherein the chassis defines a cooking module space extending from the first fixation element to the second fixation element, a surface cooking module including a frame having a first end and a second end, a first fixation bracket on the first end of the frame, the first fixation bracket engaging the first fixation element of the chassis such that the frame is pivotable about the first end of the frame when the first fixation bracket is engaged with the first fixation element, and a spring clip coupled to the second end of the frame, the second end of the frame being opposite the first end of the frame, the spring clip engaging the second fixation element of the chassis when the cooking module is pivoted downward about the first end of the frame into a mounted position in the cooking module space of the chassis.

In this way, the present invention provides a modular system with which a surface cooking module may be selectively and easily attached to, and removed from, a maintop of a household cooking appliance, such as a range. In this manner, a surface cooking module can be easily installed using a standardized method which is useful across any number of different types of cooking module functions for a range maintop. In particular, the present invention provides a system with which a forward surface of a cooking module may be tilted into the top of a range to engage or "catch" the range at a front end of the range chassis, and then the rear end of the module may be tilted or pivoted downward until a spring clip at the rear end of the module engages a rear of the range chassis. The spring clip can be selectively releasable from the range chassis using a simple tool, thereby enabling easy repair and/or replacement of the individual cooking module without requiring removal of adjacent surface cooking modules, and while minimizing a risk of damage to adjacent cooking modules and concealing fixation components from being visible to a user.

Prior to describing the exemplary embodiments in greater detail, and to provide a better understanding of the invention, this disclosure will first describe some of the problems with conventional cooking units or modules for household cooking appliances.

As explained above, a household cooking appliance may include one or more surface cooking units in a top of the household appliance. However, these conventional cooking units may require complex assembly processes, which increase the time, complexity, and cost of the manufacturing process. Additionally, the conventional cooking units may require complex and timely procedures to access and remove the cooking modules for repair and servicing by a technician in the field. For example, the procedures for accessing a conventional cooking unit may require a technician to remove one or more adjacent surface cooking units or other components in order to access the cooking module to be repaired or serviced. In this way, the conventional cooking units may not only increase the time and complexity of repairs and service to the cooking unit, but also may expose the adjacent components, which are unrelated or unaffected by a given repair, to risk of being damaged during the servicing or repair of the cooking unit. Particularly, some conventional cooking units require access to one or more sides of the cooking unit to remove the cooking unit. However, in many cases, adjacent cooking units may conceal or limit access to the sides of the cooking unit and fixation devices for removing the cooking unit, thereby requiring removal of multiple cooking units in order to service or repair a single cooking unit.

On the other hand, if the fixation devices are exposed such that adjacent cooking units do not need to be removed to service or repair the cooking unit, then the appearance of the cooking unit and appliance may be negatively affected, which is undesirable to the user. Moreover, the exposed fixation devices may be susceptible to contamination by cooking processes and may be difficult to clean, which may lead to accumulation of debris and difficulty in removing the fixation components when service or repairs are needed.

To solve the foregoing problems, a modular system has been provided in which a surface cooking module can be simply and rapidly installed in the appliance during manufacturing and simply and rapidly disassembled and removed by repair personnel in the field, while at the same time requiring at least a simple tool to remove the module and thereby limiting customer access and limiting a risk of customer injury or damage to the appliance, and also enabling compliance with applicable industry standards and requirements. The exemplary embodiments can provide a surface cooking module having front pivot-in fixation brackets and rear spring clips which can eliminate any need for external visible fasteners, which may mar the appearance of the finished product.

As explained above, the present invention provides a modular system with which a cooking module may be selectively attached to a maintop of a household cooking appliance, such as a range. In this manner, a maintop cooking module can be easily installed using a standardized method which is useful across any number of different types of cooking module functions for a range maintop. In particular, the present invention provides a system with which a forward surface of a cooking module may be tilted into the top of a range to engage or "catch" the range at a front end of the range chassis, and then the rear end of the module may be tilted or pivoted downward until a spring clip at the rear end of the module engages a rear of the range chassis. The spring clip can be selectively releasable from the range chassis using a simple tool, thereby enabling easy repair and/or replacement of the individual cooking module without requiring removal of adjacent surface cooking modules, and while minimizing a risk of damage to adjacent cooking modules and concealing fixation components from being visible to a user.

Moreover, by introducing access at the rear of each module, the exemplary embodiments enable each surface cooking module to be removed independent of other adjacent modules located to the right or left of the module. In this way, the exemplary surface cooking module can enable a particular cooking module to be more easily and more quickly serviced and repaired, while reducing a risk of damage to other modules or components that are unrelated or unaffected by a given repair, as compared to conventional designs in which one or more adjacent modules need to be removed to provide access from one or more sides of a cooking module.

The exemplary embodiments can provide a modular system in which simple front brackets and spring clips can be manufactured using common sheet metal forming equipment in a factory that is commonly used to formed other sheet metal components of a household appliance, thereby eliminating a need to buy special tooling and reducing manufacturing costs.

The exemplary embodiments can provide one or more front fixation brackets that allow uniformly sized and shaped modules to pivot into a fixed position on the front edge of the appliance. The exemplary pivot-in front fixation brackets can extend from the bottom front of each cooking module. These brackets can include one or more tabs which fit into a corresponding slot or slots formed in the range where the module mounts. In this way, the exemplary embodiments can provide a tab-in-slot fixation that limits motion forward, left to right, and upward out of the range-top, while permitting a sliding motion forward and rearward and permitting angular rotation as the module is pivoted down into place.

The exemplary embodiments can provide one or more spring clips at the rear of the module that allow the back side of each module to be attached by simply pressing the module firmly into place. The exemplary spring clips at the rear side of each module can be formed in one piece without distinct hinge and spring portions. The entire clip body can be formed from a flexible material such that the spring clip deflects to accomplish both spring and hinge functions.

The exemplary spring clips can limit motion backwards and keep the rear side of module from being lifted, which in turn limits angular rotation of the entire module about the front fixation bracket(s). The exemplary spring clips at the rear of the module can include small tabs which extend from the back of the module to a space between that module and the back-guard (island trim, low back, or high-shelf) on a range. The small tabs can be depressed with a thin tool, such as a slotted screw driver to flex the spring clips and disengage them from the rear of the range-top. In this way, the procedure for removing the module can be accomplished by simply inserting a thin instrument, such as a slotted screw driver, into a slot at the rear of the module and pressing one or more spring clip releases on either side of the module.

For purposes of this disclosure, a cooking module can include one or more of a gas burner, a steam oven, a warming drawer, a convection oven, gas burners, a griddle, a grill, an induction heating element, a teppanyaki grill, or the like. The invention is not limited to any particular type of cooking module and other cooking modules, types of cooking modules, arrangements of cooking modules, and combinations of cooking modules are contemplated by the present invention.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

Figure 1:
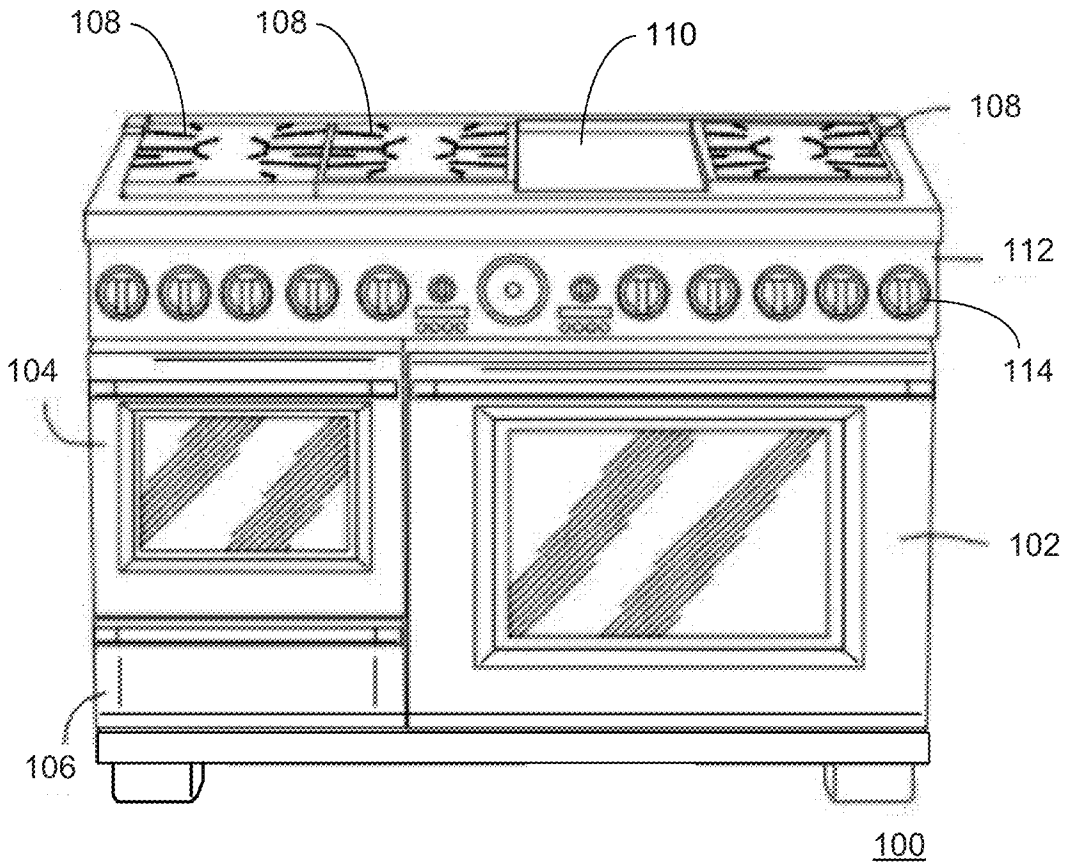
FIG. 1 is a front view of a household cooking appliance according to an exemplary embodiment of the invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 1-17 illustrate exemplary embodiments of a spring clip attachment of a surface cooking module of a household appliance, a surface cooking module having a spring clip attachment, and a household cooking appliance having such a surface cooking module having a spring clip attachment.

Examples of a household cooking appliances and surface cooking modules will first be described with reference to FIGS. 1-4B.

Figure 2:
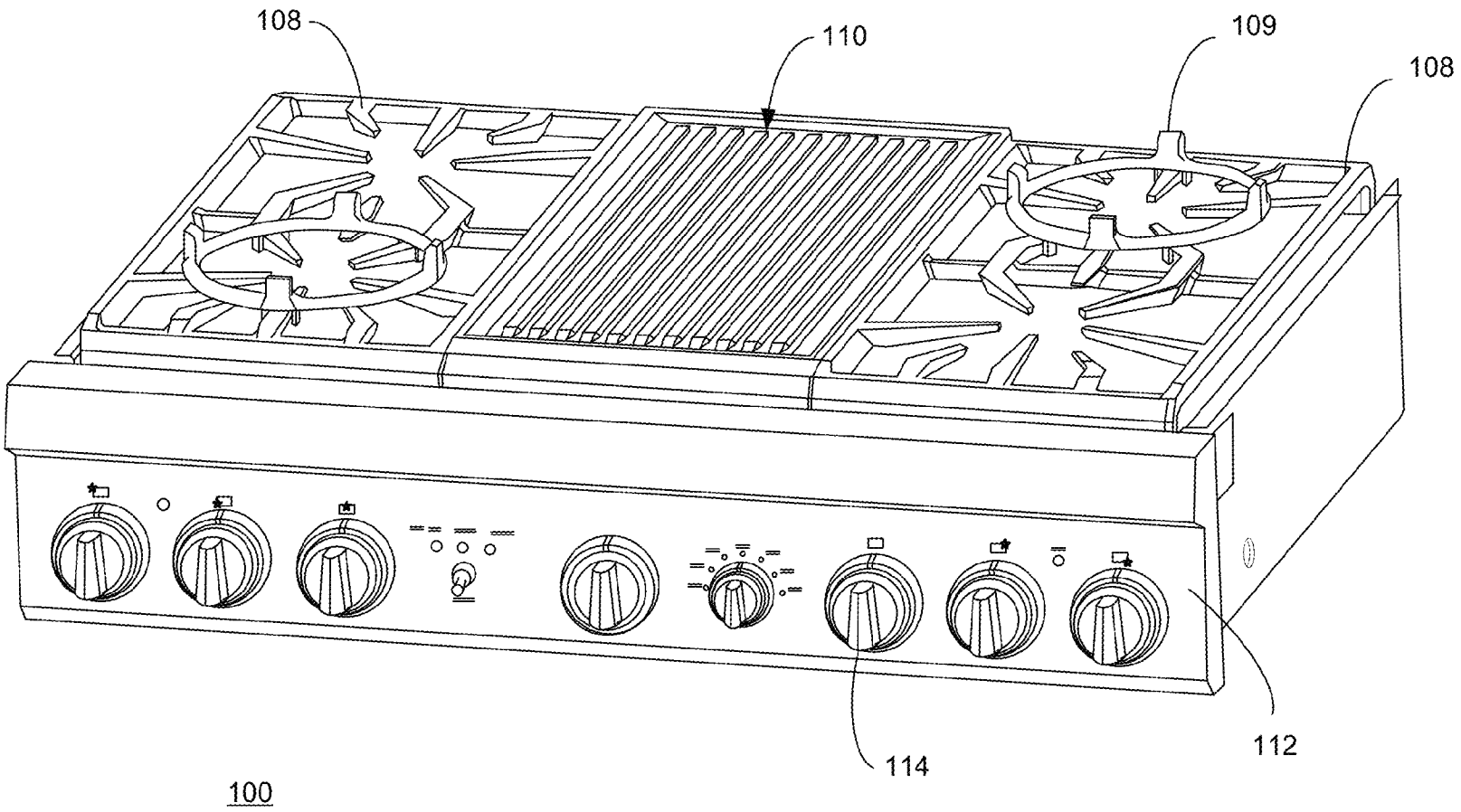
FIG. 2 is a perspective view of a range top having a cooking module according to an exemplary embodiment of the invention.

FIG. 1 illustrates an example of a household cooking appliance 100. In the example appliance of FIG. 1, the household cooking appliance 100 includes one or more of an oven 102 (e.g., baking oven or convection oven), a steam oven 104, and a warming drawer 106. The household cooking appliance 100 can include a control panel 112 having one or more control devices 114, such as control knobs, for controlling one or more components or modules of the appliance. Other arrangements and features are possible, such as a single oven range, a cooktop, among other arrangements. The appliance 100 can be a stand-alone appliance, a built-in appliance, or in-counter appliance. For example, FIG. 2 illustrates an example of a household cooking appliance 100 including a range top, which can be part of a stand-alone appliance or can be built-in to a counter.

Figure 4A:
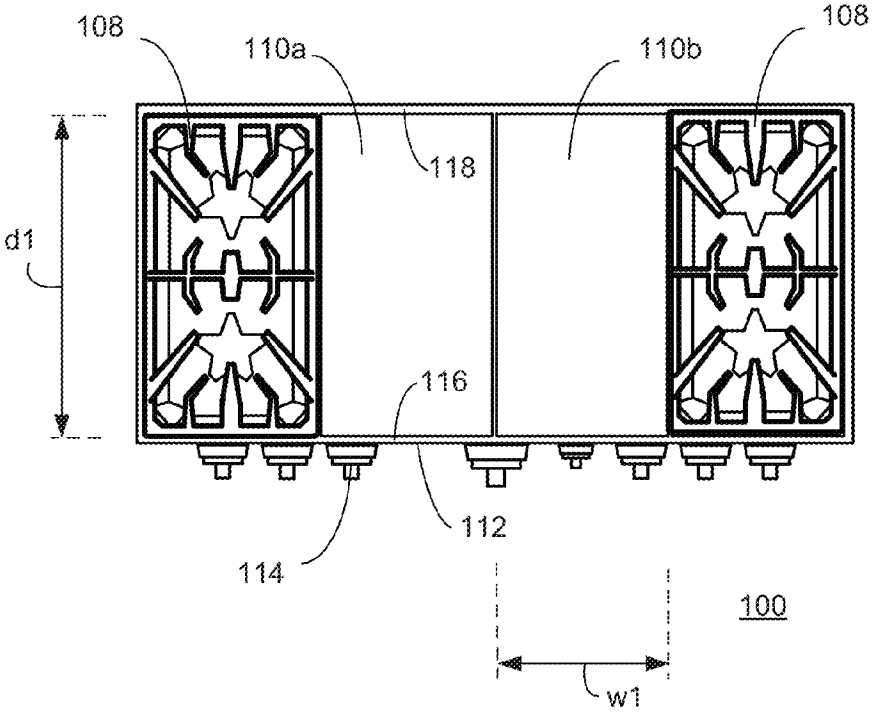
FIG. 4A is a top view of a range top having a plurality of cooking modules according to an exemplary embodiment of the invention.
Figure 3:
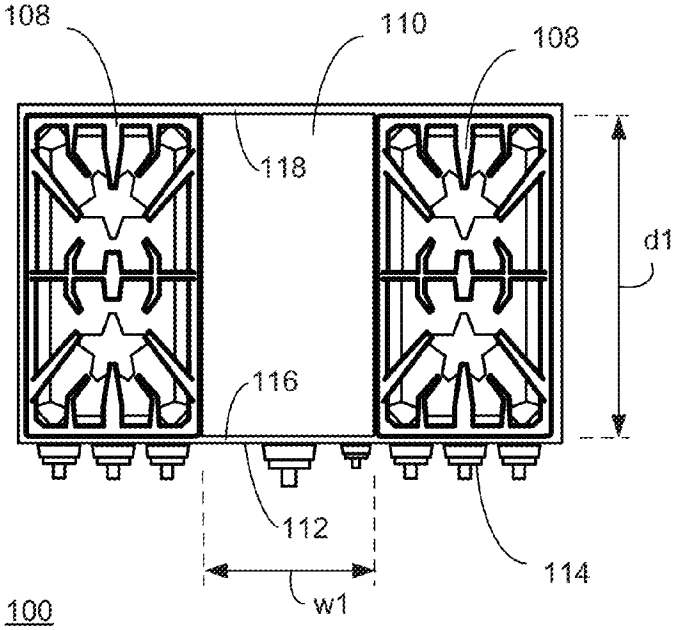
FIG. 3 is a top view of a range top having a cooking module according to an exemplary embodiment of the invention.
Figure 4B:
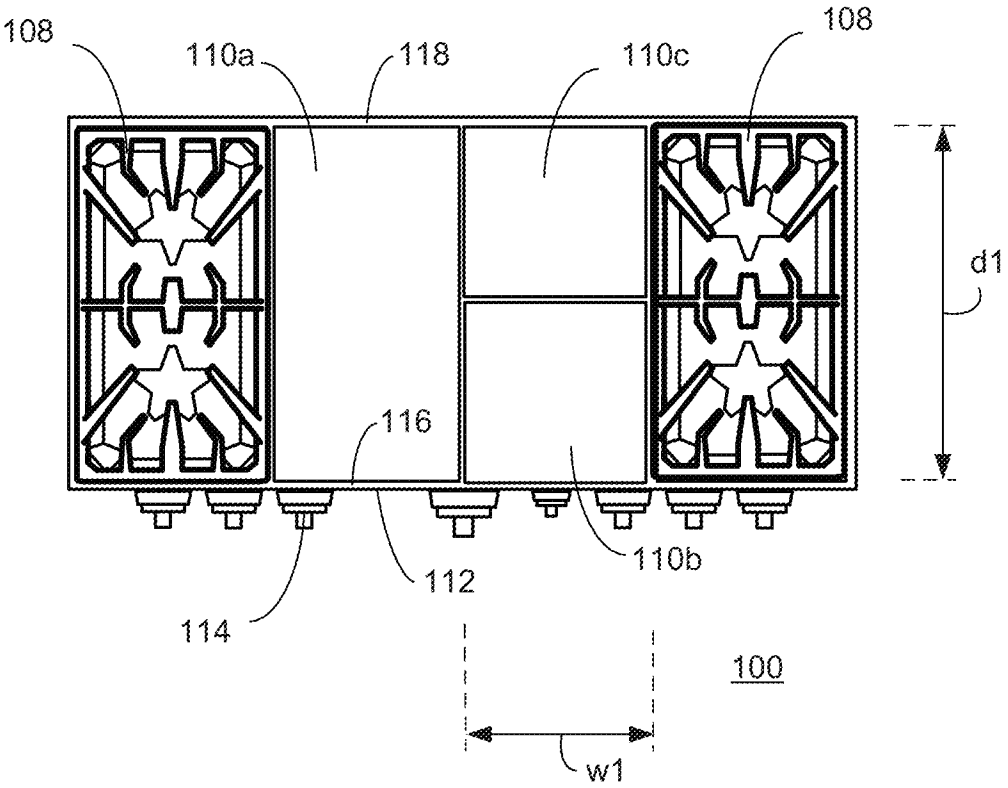
FIG. 4B is a top view of a range top having a plurality of cooking modules according to another exemplary embodiment of the invention.

A household cooking appliance 100 can include one or more gas burners 108 or induction heating elements (not shown), and/or one or more cooktop cooking modules 110, such as one or more of a griddle, a grill, an induction heating element, a teppanyaki grill, a rotisserie, or the like, as well as various accessories to such cooking devices. FIGS. 1-3 show examples of household cooking appliances 100 having a single cooking module 110 in combination with one or more gas burners 108. However, in other embodiments, the appliance 100 can include one or more modules 110*a*, 110*b*, 110*c* arranged in the appliance, for example, as shown in FIGS. 4A and 4B. The number of modules is not limited to any particular number and can include any number of modules based on the size of the appliance 100 and the size and shape of the respective modules 110. In other embodiments, the appliance 100 can be formed entirely from a plurality of modules 110 without providing gas burners 108. The modules 110 can be uniformly sized and shaped modules. However, in other embodiments, the modules 110 can have different sizes and shapes, for example, as described in greater detail below.

With reference to the example illustrated in FIG. 4B, the appliance 100 can include more than one cooking module (110*a*, 110*b*, 110*c*) arranged or disposed in a direction d1 extending from a front of the appliance 100 to the rear of the appliance 100. For example, a plurality of smaller modules 110*b*, 110*c*, which are for example half the size of the illustrated module 110*a* in the direction d1, can be arranged in place of one or more of the cooking modules illustrated in the Figures. In another example, a plurality of smaller modules that, when arranged in series, have a total length and/or a total width equal to the length d1 and/or the width w1 of the illustrated modules can be arranged in place of one or more of the cooking modules illustrated in the Figures. For example, a plurality of modules (e.g., two, three, four, etc.) having a width that is equal to the width w1 and can be arranged such that a total length of the modules is equal to a length d1. In other examples, a total width of the plurality of modules 110 can be equal to the width w1, or alternatively, to twice the width w1 (e.g., the width of two modules). The modules 110 can have other sizes and are not limited to a width w1 or a length d1. For example, a module 110 can have a width that is greater than w1 (e.g., 1.5 time the width w1) such that the module can be arranged in a width direction of the appliance along with another module that has a width that is less than w1 (e.g., a thinner module; e.g., 0.5 times the width w1) to fill the available space in the cooking appliance 100. The cooking module 110 can be specifically manufactured for arrangement in the available module spaces of a household cooking appliance 100.

An overview of a manner of installing an exemplary cooking module 110 into an appliance 100 will now be described with reference to the exemplary embodiments shown in FIGS. 1-4A and 5.

As explained above, the appliance 100 can include an available space for receiving a cooking module 110. To install the module 110, a first end of a module 110 can be positioned at a front end of the available module space of the appliance 100. The module 110 can include one or more front fixation devices (VII) configured to engage a corresponding feature formed at the front end 116 of the appliance chassis such that the module 110 can be pivoted downward into a horizontal position with respect to the range top of the appliance 100. In this example, the first module 110 is pivoted down into the available space until one or more rear fixation devices (VIII) engage a corresponding feature formed at the rear end 118 of the appliance chassis to secure the module 110 in the horizontal mounted position on the appliance 100.

To remove the module 110, the rear fixation devices (VIII) can be disengaged from the corresponding features formed at the rear end 118 of the appliance chassis using a tool. The rear end of the module 110 can be lifted upward to pivot the module 110 about the front fixation devices (VII). The front fixation devices (VII) then can be disengaged from the corresponding feature formed at the front end 116 of the appliance chassis and the module 110 can be lifted off of the appliance 100.

Various arrangements of front and rear fixation devices can be used to provide pivot-in and locking functionality of the module 110 into a mounted position on the appliance 100. Examples of arrangements and fixation devices or elements, which provide the important advantages explained in the Summary above, will now be described with reference to FIGS. 5-16.

Figure 5:
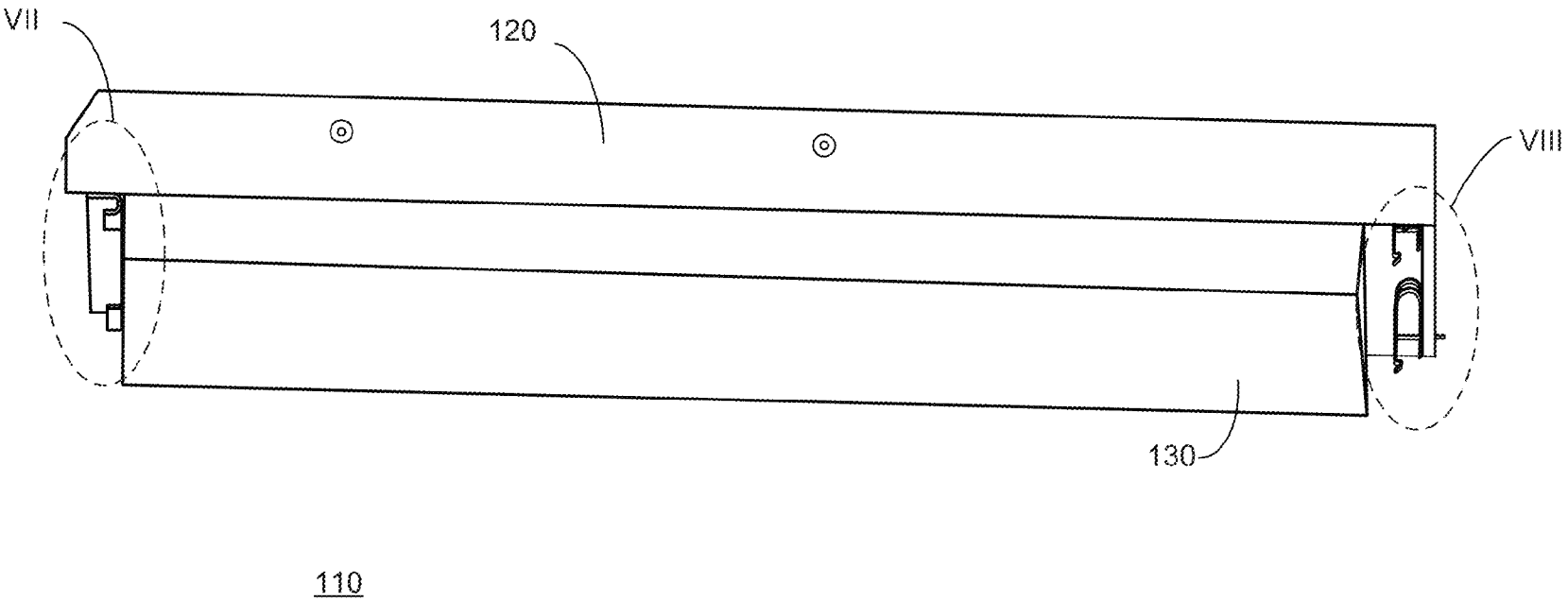
FIG. 5 is a perspective bottom view of a cooking module according to the exemplary embodiment of the invention.

As shown in FIG. 5, the module 110 can include one or more front fixation elements (VII) configured to engage a corresponding feature formed at the front end 116 of the appliance chassis such that the module 110 can be pivoted downward into a horizontal position with respect to the range top of the appliance 100, and one or more rear fixation elements (VIII) configured to engage a corresponding feature formed at the rear end 118 of the appliance chassis to secure the module 110 in the horizontal mounted position on the appliance 100.

Figure 6:
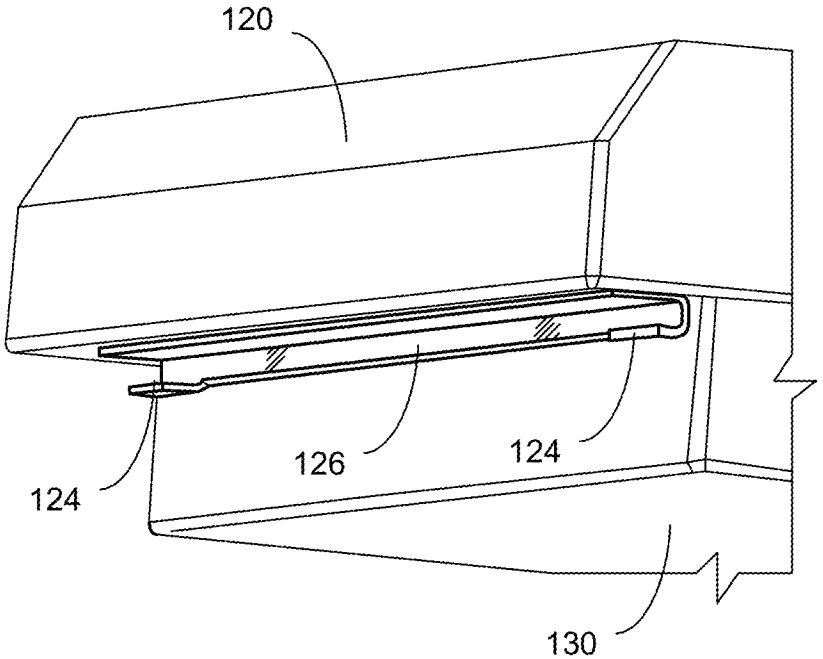
FIG. 6 is a partial, perspective, front bottom view of a range top having a cooking module according to an exemplary embodiment of the invention.

FIG. 6 is an enlargement of the front fixation element (VII) illustrated in FIG. 5. As shown in FIG. 6, the front fixation element can include, for example, a pivot-in front fixation element, which may be formed by one or more brackets or tabs 124 coupled to the frame 120 of the module 110. For example, the pivot-in front fixation element can be formed by a plurality of brackets or tabs 124 extending all or a portion of the way across a lower front part of the frame 120. The plurality of brackets or tabs 124 can be spaced (e.g., equally spaced or spaced in a pattern) across the front of the frame 120, disposed at or near each end of the front of the frame 120 as shown in FIG. 6. The tabs 124 can be separate from each other or coupled to one another by a connecting piece 126 to provide a more rigid connection between the tabs 124 and/or to the frame 120. Alternatively, the pivot-in front fixation element can be formed by a single continuous bracket or tab (not shown) extending all or a portion of the way across the lower front part of the frame 120. The tabs 124 can be formed on a recessed area of the frame 120 such that the tabs 124 are not visible from above when the module 110 is in a mounted position on the appliance 100.

Figure 8A:
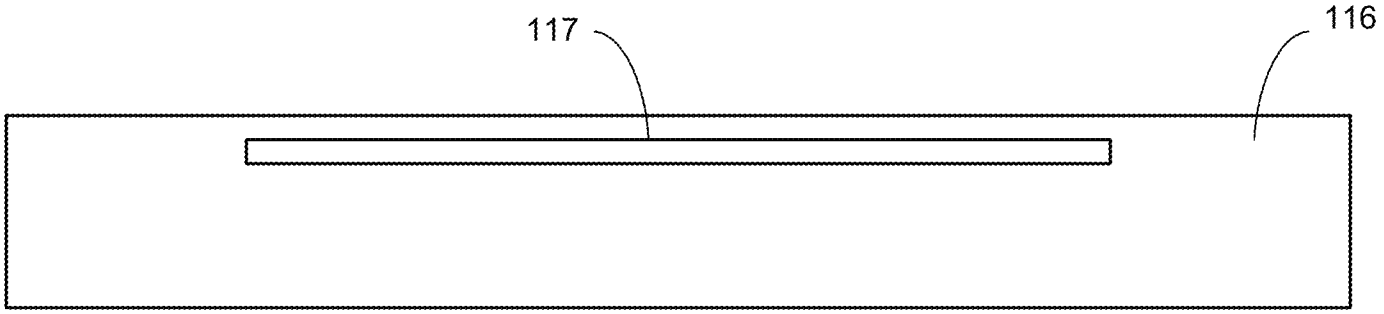
FIGS. 8A and 8B are partial, rear views of a front end of a chassis of a household cooking appliance according to an exemplary embodiment of the invention.
Figure 8B:
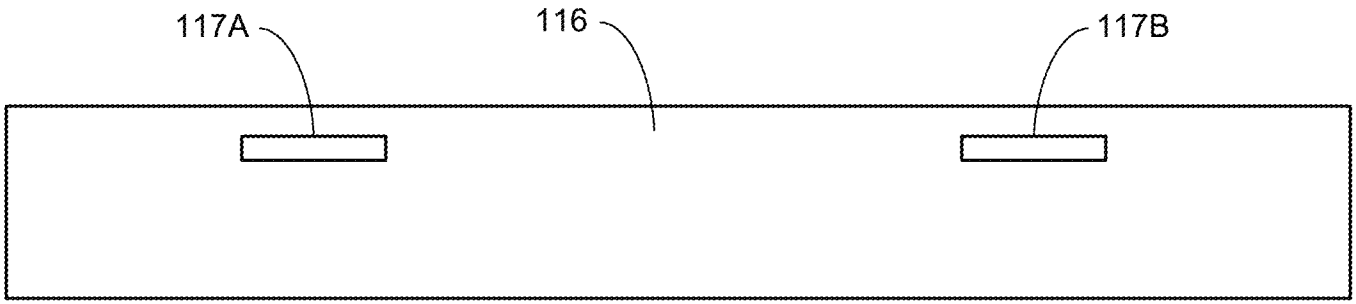
Figure 9:
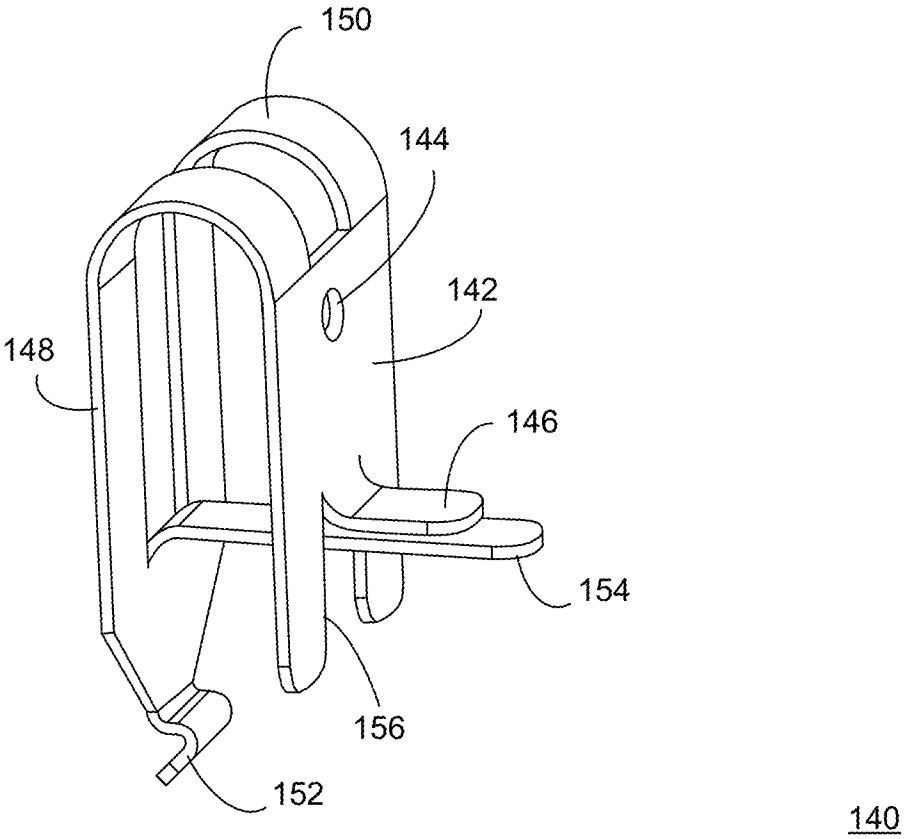
FIG. 9 is a perspective view of a spring clip for a cooking module according to an exemplary embodiment of the invention.
Figure 12:
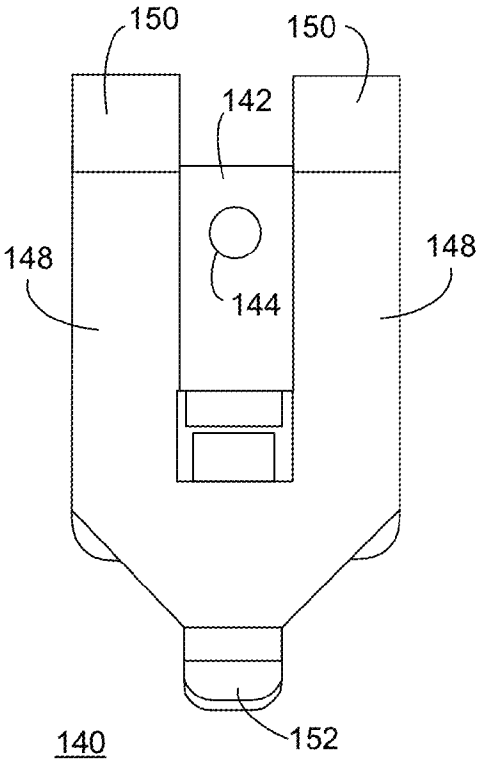
FIG. 12 is a rear view of the spring clip for a cooking module according to the exemplary embodiment of the invention illustrated in FIG. 9.
Figure 11:
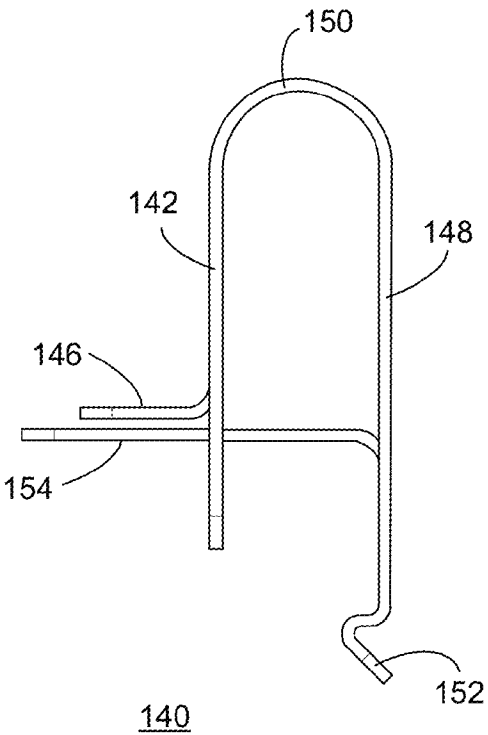
FIG. 11 is a side view of the spring clip for a cooking module according to the exemplary embodiment of the invention illustrated in FIG. 9.
Figure 10:
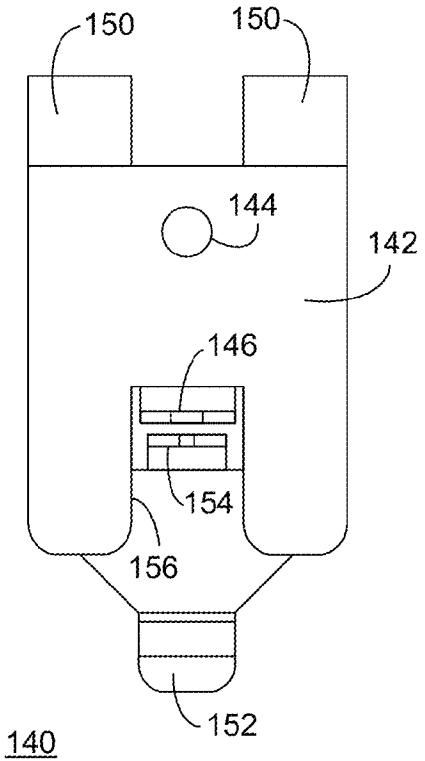
FIG. 10 is a front view of the spring clip for a cooking module according to the exemplary embodiment of the invention illustrated in FIG. 9.
Figure 13:
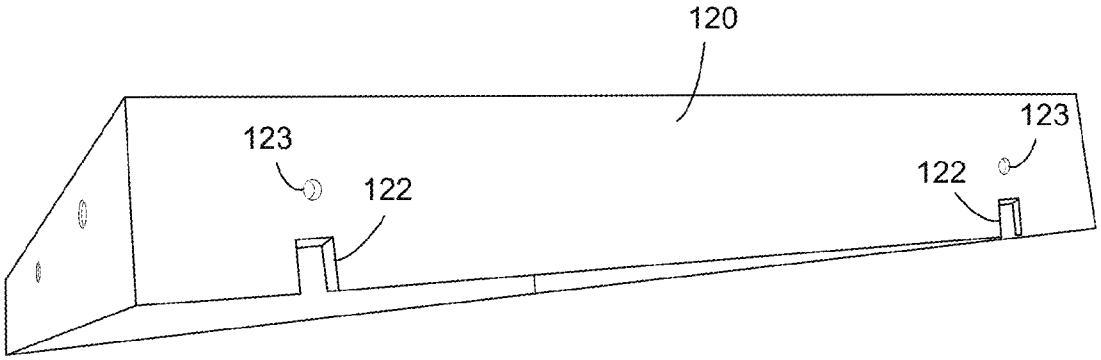
FIG. 13 is a rear view of a frame of a cooking module according to an exemplary embodiment of the invention.
Figure 14:
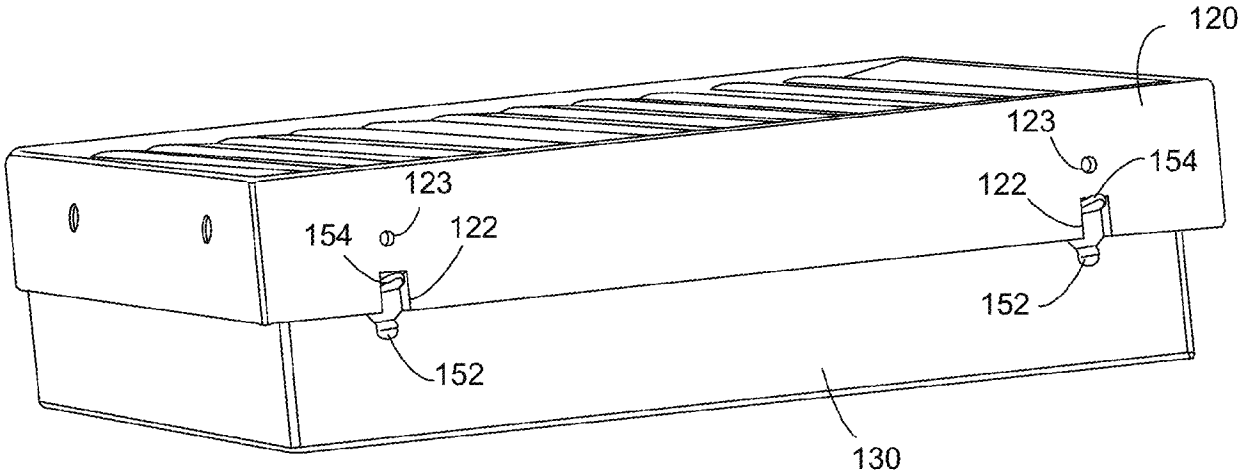
FIG. 14 is a perspective rear view of a cooking module according to an exemplary embodiment of the invention.
Figure 15:
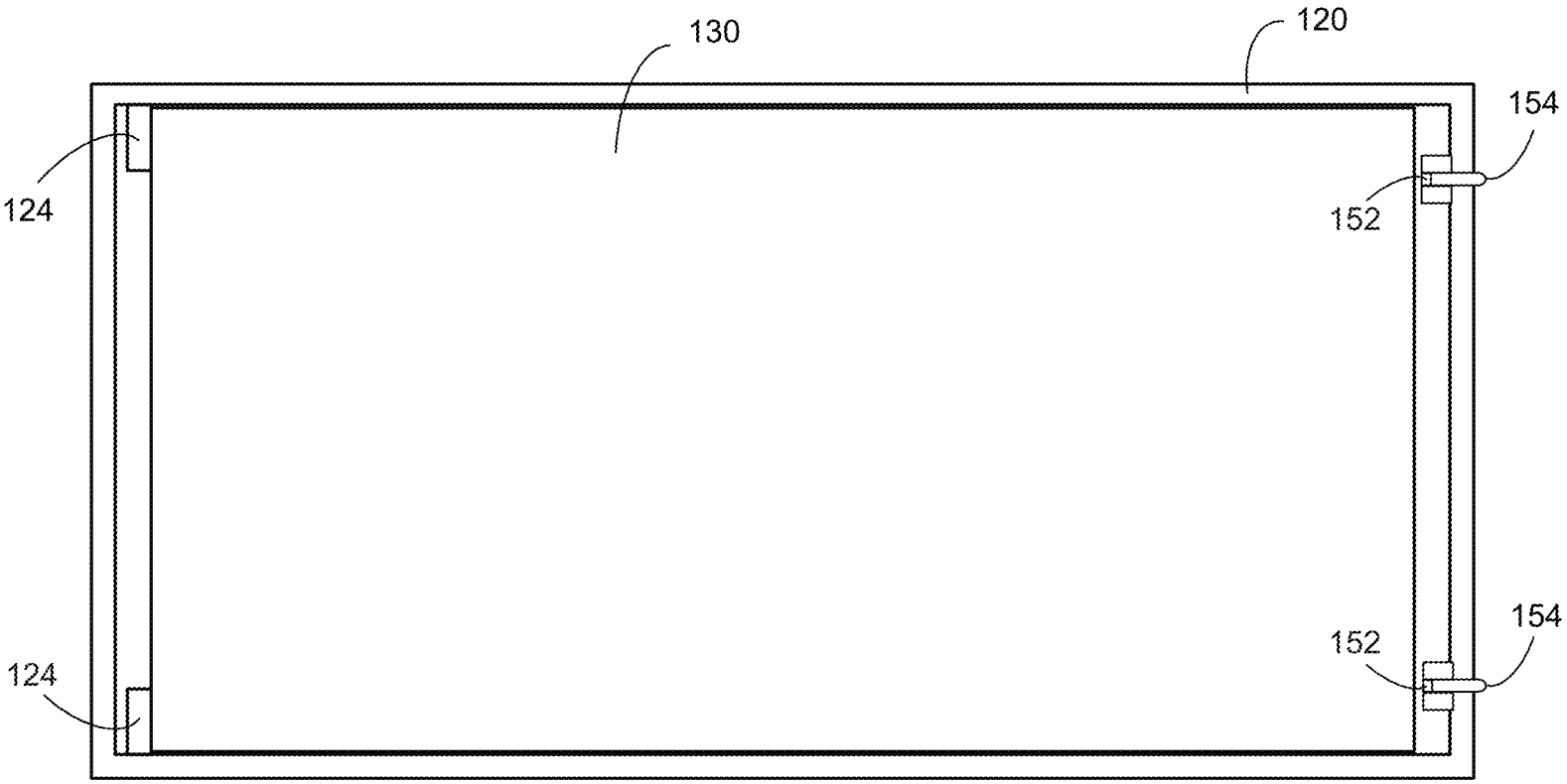
FIG. 15 is a bottom view of a cooking module according to an exemplary embodiment of the invention.

The front end 116 of the appliance chassis (shown in FIGS. 3-4B) can include a corresponding feature, such as one or more slots 117, 117A, 117B in FIGS. 8A and 8B, formed at the front end 116 of the appliance chassis, or more particularly, formed on an inside face of the front end 116 of the appliance chassis, such that the tabs 124 of the module 110 can be inserted into the slots 117 and the module 110 can be pivoted downward into a horizontal position with respect to the range top of the appliance 100. The front end 116 of the appliance chassis can include a continuous slot 117 as shown in FIG. 8A for receiving a plurality of tabs 124, or a plurality of slots 117A, 117B as shown in FIG. 8B corresponding to the particular locations of the tabs 124. The plurality of slots also can be spaced (e.g., equally spaced) along the inner surface of the front end 116. As explained above, the tabs 124 can be formed on a recessed area of the frame 120 such that a portion of the module 110 overlaps part of the front end 116 of the appliance chassis when the module 110 is in a mounted position on the appliance 100, thereby concealing the tabs 124 and corresponding slots 117 on the appliance chassis from view by a user.

Figure 7:
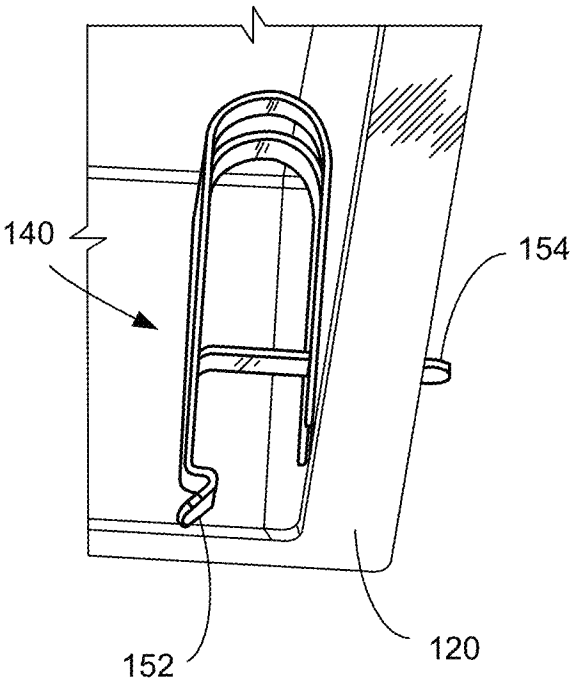
FIG. 7 is a partial, perspective, rear bottom view of a range top having a cooking module according to an exemplary embodiment of the invention.

FIG. 7 is an enlargement of the rear fixation element (VIII) illustrated in FIG. 5. As shown in FIG. 7, the rear fixation element (VIII) can include, for example, a spring-clip 140 coupled to an inner side of the frame 120 of the cooking module 110. The spring-clip 140 includes a latch 152 for engaging and locking the cooking module 110 to the rear end 118 of the chassis of the household cooking appliance 100. The spring-clip 140 includes a spring clip release tab 154 that projects rearward of the frame 120 of the cooking module 110 for selectively releasing the spring-clip release tab 154 from the rear end 118 of the chassis.

Additional features of the spring-clip 140 and engagement of the spring-clip 140 with the chassis of the household appliance will be described with reference to FIGS. 7 and 9-17.

As shown in FIGS. 9-12, an exemplary embodiment of a spring-clip 140 can include a unitary arrangement without distinct hinge or spring portions. The entire body of the spring-clip 140 can be formed from a flexible material (e.g., flexible metal) such that the spring-clip deflects to accomplish both spring and hinge functions. The spring-clip 140 includes, for example, a U-shaped body formed by a first portion 142 and a second portion 148 connected by a curved return portion 150 such that the first portion 142 is opposed to the second portion 148. The flexible material of the spring clip enables the first portion 142 to move or flex with respect to the second portion 148. The first portion 142 includes means for coupling the spring-clip 140 to the frame 120 of the cooking module 110. The means for coupling can include, for example, an opening 144 for receiving a fastener (not shown), such as a screw, pin, rivet, etc., and/or an alignment tab 146 for engaging a slot or opening formed in the frame 120, such as slot 122 shown in FIGS. 13 and 14.

Figure 16:
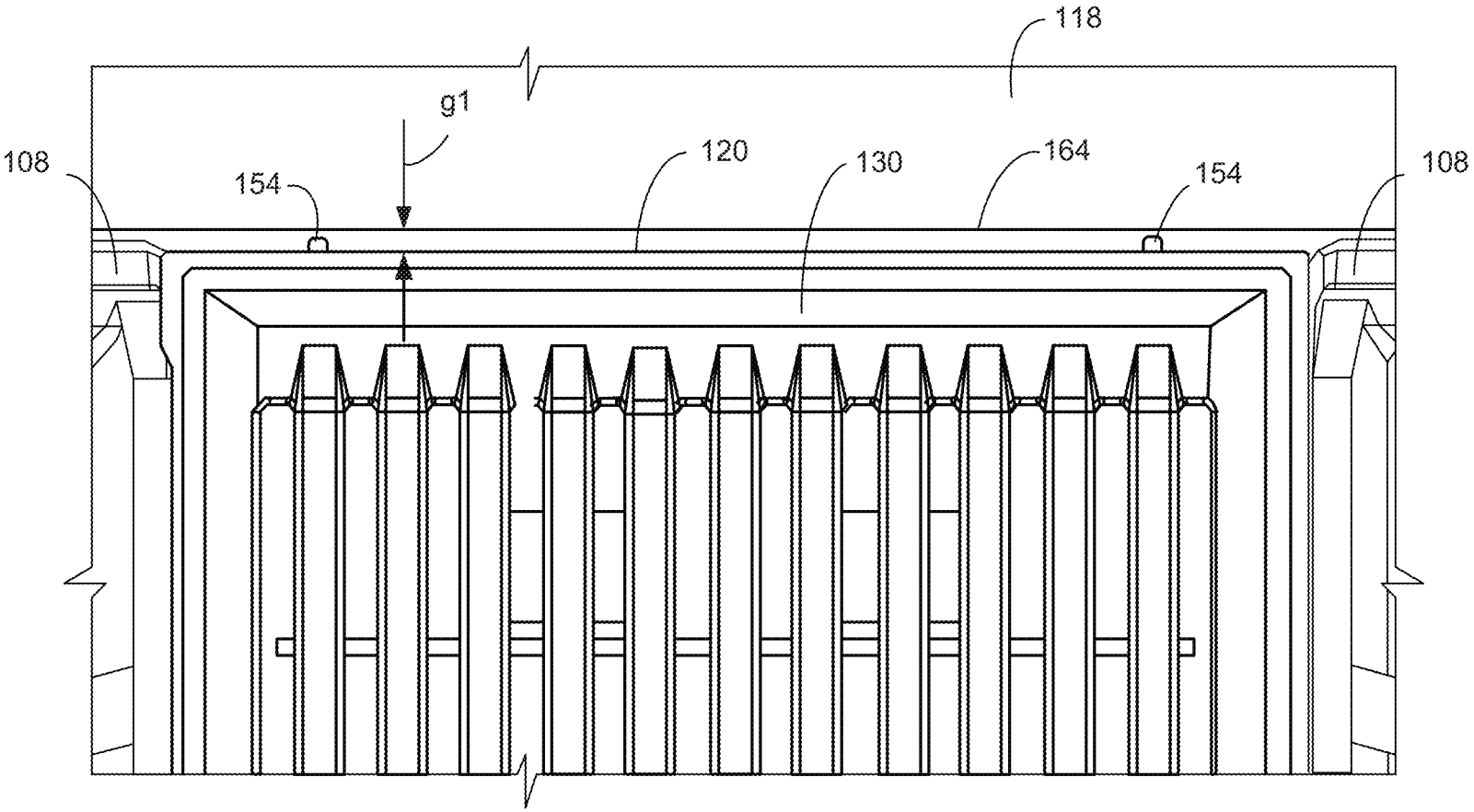
FIG. 16 is a partial top view of a cooking module according to an exemplary embodiment of the invention.
Figure 17:
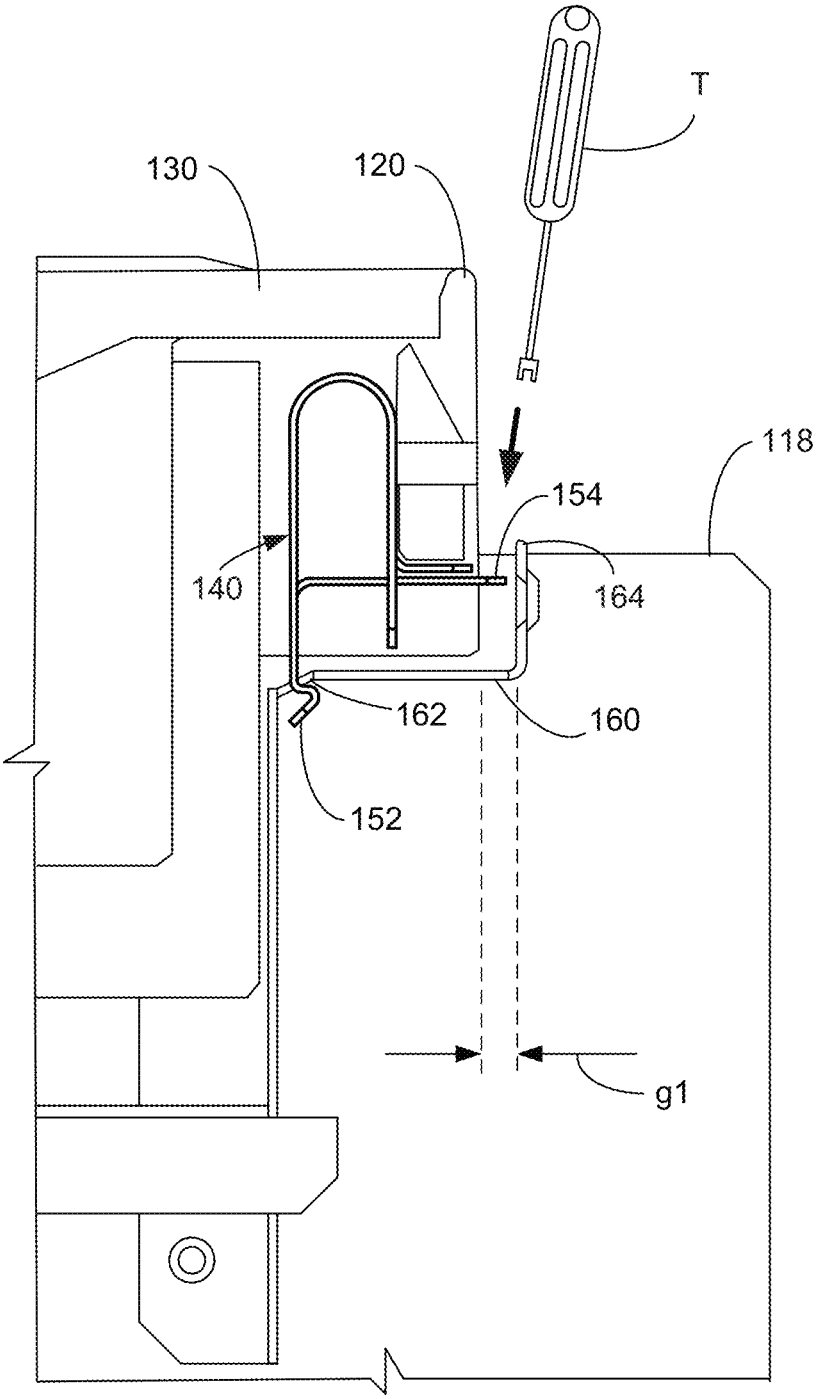
FIG. 17 is a partial, side cut-away view of a range top having a cooking module according to an exemplary embodiment of the invention.

The spring-clip 140 includes a latch 152 for engaging and locking the cooking module 110 to the rear end 118 of the chassis of the household cooking appliance 100. The spring-clip 140 includes a spring clip release tab 154 that projects from the second portion 148 toward the first portion 142. The spring-clip release tab 154 can be formed on the second portion 148 by cutting or stamping the spring-clip release tab 154 from the second portion 148 and bending or curving the spring-clip release tab 154 away from the second portion 148 and into position. The first portion 142 includes a cutout or slot 156 that permits the spring clip release tab 154 to extend beyond the first portion 142 such that the spring clip release tab 154 can project rearward of the frame 120, as shown in FIGS. 9, 11, and 14-17, when the spring-clip 140 is coupled to the frame 120. In this way, a portion of the spring-clip release tab 154 extending beyond the frame 120 can be depressed using a tool, such as a slotted screwdriver T (schematically shown in FIG. 17) or the like, to flex the second portion 148 with respect to the first portion 142 and thereby selectively release the latch 152 from the rear end 118 of the chassis. Particularly, the portion of the spring clip release tab 154 can extend into an area or gap g1 rearward of the module 110, as shown in FIGS. 16 and 17, such that the spring clip release tab 154 can be accessed using a tool T from above the rear end of the module 110.

The slot 156 can be formed in the first portion 142 by cutting or stamping the alignment tab 146 from the first portion 142 and bending or curving the alignment tab 146 away from the first portion 142 and into position, thereby forming the slot 156 in its place. As shown in FIGS. 9, 11, and 14-17, when the spring clip release tab 154 extends through the slot 156 beyond the first portion 142, the spring clip release tab 154 can be adjacent to the alignment tab 146 but projecting beyond the alignment tab 146 such that the portion of the spring-clip release tab 154 extending beyond the frame 120 can be depressed using the tool T to flex the second portion 148 with respect to the first portion 142 and thereby selectively release the latch 152 from the rear end 118 of the chassis.

As explained above, the latch 152 can engage and be selectively released from a corresponding feature formed in the rear end 118 of the chassis. For example, as shown in FIG. 17, the chassis can include surface or ledge 160 having a slot 162 that receives the latch 152, thereby locking the latch 152, and by extension the module 110, in position on the chassis of the household appliance 100. As shown in FIGS. 16 and 17, the spring clip release tab 154 extends beyond the frame 120, for example into a gap g1 between the frame 120 and a wall or flange 164 of the rear end 118 (e.g., between the rear of the frame 120 and a back-guard, island trim, low back, high-shelf, etc. on the range). In this way, a tool T can be inserted into the gap g1 to depress the spring clip release tab 154, thereby causing the second portion 148 of the spring clip 140 to flex with respect to the first portion 142 and selectively releasing the latch 152 from the slot 162 in the rear end 118 of the chassis.

To summarize, the exemplary embodiments provide a surface cooking module 110 that can be easily installed using a standardized method which is useful across any number of different types of cooking module functions for a range maintop. With reference again to FIGS. 1-17, to install the exemplary module 110, a first end of a module 110 can be positioned at a forward end of the available module space of the appliance 100 and tilted into the top of the range to engage or "catch" a corresponding slot or slots (e.g., 117, 117A, 117B in FIGS. 8A and 8B) of the range at the front end 116 of the range chassis. Next, the rear end of the module 110 may be tilted or pivoted downward until the spring clip 140, and particularly the latch 152 of the spring clip 140, at the rear end of the module engages the rear end 118 of the range chassis, and particularly the slot 162 of the rear end 118 (shown in FIG. 17). In this way, the exemplary embodiments provide a tilt-and-click method of installing the module 110 in the rangetop without requiring any tools. Particularly, the module 110 can be tilted into positions and pivoted into a horizontal position in the rangetop until the spring clip 'clicks' into engagement with the rangetop.

To remove the module 110, the spring clip 140 can be selectively releasable from the range chassis using a simple tool T to depress the release tab 154 of the spring clip 140, thereby enabling easy repair and/or replacement of the individual cooking module 110 without requiring removal of adjacent surface cooking modules, and while minimizing a risk of damage to adjacent cooking modules and concealing fixation components from being visible to a user.

As explained above, in an alternative embodiment, the appliance 100 can include more than one cooking module 110 arranged or disposed in a direction (d1 in FIGS. 3-4B) extending from a front of the appliance 100 to the rear of the appliance 100. For example, a plurality of smaller modules 110*b*, 110*c* (shown in FIG. 4B) can be arranged in place of one or more of the cooking modules 110 illustrated in the Figures. In this example, a first module 110*b* (shown in FIG. 4B) can be positioned at a forward end of the available module space of the appliance 100 and tilted into the top of the range to engage or "catch" a corresponding slot or slots (e.g., 117, 117A, 117B in FIGS. 8A and 8B) of the range at the front end 116 of the range chassis. Next, the rear end of the module 110*b* may be tilted or pivoted downward until the spring clip 140, and particularly the latch 152 of the spring clip 140, at the rear end of the module 110*b* engages a part of the range chassis. In this example, the range chassis can include an additional ledge or flange (not visible in FIG. 4B), which is disposed at a location between the front end 116 and the rear end 118 and corresponding to a length of the first module 110*b*. The additional ledge or flange can be configured to have a fixed location between the front end 116 and the rear end 118 that corresponds to a fixed length of the modules 110*b*, 110*c*, or the additional ledge or flange can be configured to be adjustable (e.g. slidable) along the length between the first end 116 and the second end 118, to accommodate a variety of modules having different lengths. The additional ledge or flange can include a corresponding feature (e.g., a slot) for receiving the latch 152 of the first module 110*b*, similar to the ledge 160 shown in the embodiment illustrated in FIG. 17. Alternatively, the first module 110*b* can be tilted into a horizontal position without engaging a part of the range chassis.

Next, the second module 110*c* can (shown in FIG. 4B) can be positioned at a rear end of the first module 110*b* and tilted into the top of the range to engage or "catch" a corresponding feature (e.g., a slot) formed on the additional ledge or flange (not visible in FIG. 4B) of the range chassis. Particularly, the additional ledge or flange can include a corresponding feature (e.g., a slot or slots similar to the slots 117, 117A, 117B of the front end 116) for receiving the tabs 124 of the second module 110*c*. Alternatively, the tabs 124 of the second module 110*c* can be configured to engage the first module 110*b*. For example, the tabs 124 of the second module 110*c* can be configured to engage a slot or slots (not shown; similar to the slots 117, 117A, 117B of the front end 116) in the frame 120 of the first module 110*b* or in an additional part coupled to the first module 110*b*. In another example, the tabs 124 of the second module 110*c* can be configured to engage the spring clip 140 of the first module 110*b*.

Next, the rear end of the second module 110*c* may be tilted or pivoted downward until the spring clip 140 of the second module 110*c*, and particularly the latch 152 of the spring clip 140, at the rear end of the second module 110*c* engages the rear end 118 of the range chassis, and particularly the slot 162 of the rear end 118 (shown in FIG. 17). In this way, the exemplary embodiments provide a tilt-and-click method of installing a plurality of modules 110*b*, 110*c* in the rangetop without requiring any tools. Particularly, each of the modules 110*a*, 110*b*, and 110*c* shown in FIG. 4B can be tilted into positions and pivoted into a horizontal position in the rangetop until the spring clip of each module 'clicks' into engagement with the rangetop.

To remove the modules 110*b*, 110*c*, the spring clip 140 of the second module 110*c* can be selectively releasable from the range chassis using a simple tool T to depress the release tab 154 of the spring clip 140, thereby enabling easy repair and/or replacement of the individual cooking module 110 without requiring removal of adjacent surface cooking modules on each side, and while minimizing a risk of damage to adjacent cooking modules and concealing fixation components from being visible to a user. In the example in which the first and second modules 110*b*, 110*c* separately engage an additional ledge or flange of the range chassis, each of the modules 110*b*, 110*c* can be separately installed or removed without affecting the other module or requiring installation or removal of the other module. For example, the release tab 154 of the first module 110*b* may be accessible via a gap formed between the first module 110*b* and the second module 110*c*.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A surface cooking module for a household cooking appliance, the surface cooking module comprising:

a frame having a first end and a second end;

a first fixation bracket on the first end of the frame, the first fixation bracket for engaging a corresponding first fixation element in a chassis of the household cooking appliance and enabling the frame to pivot about the first end of the frame when engaged with the first fixation element; and a spring clip coupled to the second end of the frame, the second end of the frame being opposite the first end of the frame, the spring clip for engaging a second fixation element in the chassis of the household cooking appliance when the cooking module is pivoted downward about the first end of the frame into a mounted position on the household cooking appliance, the spring clip comprising:

a first body portion coupled to the frame;

a second body portion;

a return portion connecting the first body portion and the second body portion such that the first body portion is opposed to the second body portion and the first body portion is movable with respect to the second body portion;

a latch on the second body portion, the latch for engaging the second fixation element of the chassis; and a release tab on the second body portion for moving the second body portion with respect to the first body portion to selectively disengage the latch from the second fixation element.

2. The surface cooking module of claim 1, wherein the spring clip is selectively releasable from the second fixation element of the chassis to enable the surface cooking module to be removable from the household cooking appliance.

3. The surface cooking module of claim 1, wherein the release tab extends away from the second body portion toward the first body portion, and wherein an end part of the release tab extends beyond the first body portion such that the end part is disposed on an opposite side of the first body portion from the second body portion.

4. The surface cooking module of claim 3, wherein the first body portion includes a first cutout or slot, and wherein the release tab extends through the first cutout or slot of the first body portion.

5. The surface cooking module of claim 1, wherein the spring clip is coupled to an inner side of the frame, wherein the frame includes a second cutout or slot, and wherein the release tab extends through the second cutout or slot to an exterior side of the frame.

6. The surface cooking module of claim 5, wherein the first body portion includes an alignment tab that engages a cutout or slot of the frame.

7. The surface cooking module of claim 6, wherein the alignment tab is adjacent to the release tab in the cutout or slot of the frame, and wherein the end part of the release tab extends beyond the alignment tab such the end part of the release tab is accessible for moving the second body portion with respect to the first body portion to selectively disengage the latch from the second fixation element.

8. The surface cooking module of claim 1, further comprising:

means for coupling the first body portion to the frame.

9. The surface cooking module of claim 1, wherein the first fixation bracket includes a tab for engaging the corresponding first fixation element.

10. A household cooking appliance comprising:

a chassis having a first fixation element and a second fixation element, wherein the chassis defines a cooking module space extending from the first fixation element to the second fixation element;

a surface cooking module including:

a frame having a first end and a second end;

a first fixation bracket on the first end of the frame, the first fixation bracket engaging the first fixation element of the chassis such that the frame is pivotable about the first end of the frame when the first fixation bracket is engaged with the first fixation element; and a spring clip coupled to the second end of the frame, the second end of the frame being opposite the first end of the frame, the spring clip engaging the second fixation element of the chassis when the cooking module is pivoted downward about the first end of the frame into a mounted position in the cooking module space of the chassis the spring clip comprising:

a first body portion coupled to the frame;

a second body portion;

a return portion connecting the first body portion and the second body portion such that the first body portion is opposed to the second body portion and the first body portion is movable with respect to the second body portion;

a latch on the second body portion, the latch engaging the second fixation element of the chassis; and a release tab on the second body portion for moving the second body portion with respect to the first body portion to selectively disengage the latch from the second fixation element.

11. The household cooking appliance of claim 10, wherein the first fixation element of the chassis includes one or more slots formed in a first surface of the chassis and the first fixation bracket includes one or more tabs engaging the one or more first slots, wherein the second fixation element of the chassis includes one or more second slots formed in a second surface of the chassis and the spring clip engages the one or more second slots.

12. The household cooking appliance of claim 11, wherein the spring clip is selectively releasable from the second fixation element of the chassis to enable the surface cooking module to be removable from the household cooking appliance.

13. The household cooking appliance of claim 10, wherein the release tab extends away from the second body portion toward the first body portion, and wherein an end part of the release tab extends beyond the first body portion such that the end part is disposed on an opposite side of the first body portion from the second body portion.

14. The household cooking appliance of claim 13, wherein the first body portion includes a first cutout or slot, and wherein the release tab extends through the first cutout or slot of the first body portion.

15. The household cooking appliance of claim 13, wherein the spring clip is coupled to an inner side of the frame, and wherein the frame includes a second cutout or slot that permits the release tab to extend to an exterior side of the frame.

16. The household cooking appliance of claim 15, wherein the first body portion includes an alignment tab that engages a cutout or slot of the frame.

17. The household cooking appliance of claim 16, wherein the alignment tab is adjacent to the release tab in the cutout or slot of the frame, and wherein the end part of the release tab extends beyond the alignment tab such the end part of the release tab is accessible for moving the second body portion with respect to the first body portion to selectively disengage the latch from the second fixation element.

18. The household cooking appliance of claim 10, further comprising:

a fastener coupling the first body portion to the frame.

19. The household cooking appliance of claim 10, wherein the second fixation element of the chassis includes one or more second slots formed in a second surface of the chassis, and wherein the latch of the spring clip engages the one or more second slots.

20. The household cooking appliance of claim 10, wherein the first fixation element is at a front end of the chassis and the second fixation element is at a rear end of the chassis.

21. The household cooking appliance of claim 10, wherein the first fixation element is at a front end of the chassis, and wherein the second fixation element is at a location between the front end of the chassis and a rear end of the chassis.

22. The household cooking appliance of claim 21, further comprising:

a second surface cooking module on the chassis, the second surface cooking module being arranged between the surface cooking module and the rear end of the chassis.

23. The household cooking appliance of claim 10, wherein the first fixation element is at a location between a front end of the chassis and a rear end of the chassis, and wherein the second fixation element is at the rear end of the chassis.

24. The household cooking appliance of claim 23, further comprising:

a second surface cooking module on the chassis, the second surface cooking module being arranged between the front end of the chassis and the surface cooking module.

* * * * *